US010808911B2

(12) United States Patent
Schmidt et al.

(10) Patent No.: US 10,808,911 B2
(45) Date of Patent: Oct. 20, 2020

(54) LUMINAIRE WITH PYRAMID-SHAPED OR CONICAL COVER

(71) Applicants: OSRAM GmbH, Munich (DE); Siteco Beleuchtungstechnik GmbH, Traunreut (DE)

(72) Inventors: Tobias Schmidt, Garching (DE); Alexander Faller, Dachau (DE); Stephan Lukanow, Krailing (DE)

(73) Assignee: Siteco GmbH, Traunreut (DE)

( * ) Notice: Subject to any disclaimer, the term of this patent is extended or adjusted under 35 U.S.C. 154(b) by 102 days.

(21) Appl. No.: 16/072,888

(22) PCT Filed: Jan. 25, 2017

(86) PCT No.: PCT/EP2017/051557
§ 371 (c)(1),
(2) Date: Jul. 26, 2018

(87) PCT Pub. No.: WO2017/129623
PCT Pub. Date: Aug. 3, 2017

(65) Prior Publication Data

US 2019/0032885 A1 Jan. 31, 2019

(30) Foreign Application Priority Data

Jan. 26, 2016 (DE) ..... 10 2016 101 345

(51) Int. Cl.
*F21V 3/04* (2018.01)
*F21V 3/02* (2006.01)
(Continued)

(52) U.S. Cl.
CPC ..... *F21V 3/049* (2013.01); *F21V 3/02* (2013.01); *F21V 5/004* (2013.01); *F21V 5/02* (2013.01);
(Continued)

(58) Field of Classification Search
None
See application file for complete search history.

(56) References Cited

U.S. PATENT DOCUMENTS 8,324,790 B1 12/2012 Hu
2003/0053310 A1 3/2003 Sommers
(Continued)

FOREIGN PATENT DOCUMENTS

DE 102011107893 A1 1/2013
DE 102012102119 A1 9/2013
WO 2015090706 A1 6/2015

OTHER PUBLICATIONS

International Search Report based on application No. PCT/EP2017/051557 (4 pages + 3 pages English translation) dated Mar. 8, 2017 (for reference purpose only).
(Continued)

*Primary Examiner* — Ashok Patel
(74) *Attorney, Agent, or Firm* — Viering, Jentschura & Partner mbB

(57) ABSTRACT

A luminaire comprising: a light source in the form of at least one LED and a reflector, wherein a peripheral edge of the reflector defines a light exit opening on a side opposite the light source, wherein arranged in the light exit opening is a planar translucent cover wherein microstructures configured to direct and/or scatter light are distributed over the planar translucent cover. The planar translucent cover extends inwards in the direction of the light source, relative to an imaginary plane defined by the peripheral edge of the reflector.

16 Claims, 10 Drawing Sheets

(51) Int. Cl.

| | |
|---|---|
| ***F21V 5/00*** | (2018.01) |
| ***F21V 13/04*** | (2006.01) |
| ***F21V 7/00*** | (2006.01) |
| ***F21V 5/02*** | (2006.01) |
| ***F21Y 115/10*** | (2016.01) |
| *F21Y 105/16* | (2016.01) |
| *F21Y 105/18* | (2016.01) |
| *F21W 131/301* | (2006.01) |
| *F21Y 115/15* | (2016.01) |
| *F21Y 105/12* | (2016.01) |
| *F21Y 113/13* | (2016.01) |

(52) U.S. Cl.

CPC ..... *F21V 7/0025* (2013.01); *F21V 7/0091* (2013.01); *F21V 13/04* (2013.01); *F21W 2131/301* (2013.01); *F21Y 2105/12* (2016.08); *F21Y 2105/16* (2016.08); *F21Y 2105/18* (2016.08); *F21Y 2113/13* (2016.08); *F21Y 2115/10* (2016.08); *F21Y 2115/15* (2016.08)

(56) References Cited

U.S. PATENT DOCUMENTS

| | | | | |
|---|---|---|---|---|
| 2010/0254128 | A1 | 10/2010 | Pickard et al. | |
| 2012/0262915 | A1* | 10/2012 | Lin ..... | F21V 7/0008 362/235 |
| 2013/0114257 | A1 | 5/2013 | Schroll | |
| 2014/0211482 | A1 | 7/2014 | Wang He | |
| 2014/0211484 | A1 | 7/2014 | Howe | |
| 2015/0029717 | A1 | 1/2015 | Shen et al. | |
| 2015/0036114 | A1 | 2/2015 | Schadt et al. | |
| 2015/0092419 | A1 | 4/2015 | De Visser et al. | |
| 2015/0097198 | A1 | 4/2015 | Illek et al. | |

OTHER PUBLICATIONS

German Search Report based on application No. 10 2016 101 345.5 (6 pages) dated Sep. 21, 2016 (for reference purpose only).

* cited by examiner

LUMINAIRE WITH PYRAMID-SHAPED OR CONICAL COVER

CROSS-REFERENCE TO RELATED APPLICATION

The present application is a national stage entry according to 35 U.S.C. § 371 of PCT application No.: PCT/EP2017/051557 filed on Jan. 25, 2017, which claims priority from German Patent Application Serial No.: 10 2016 101 345.5 which was filed Jan. 26, 2016, and is incorporated herein by reference in its entirety and for all purposes.

TECHNICAL FIELD

The present description relates to a luminaire having a light source consisting of at least one LED, a reflector and a transparent cover.

BACKGROUND

Luminaires which contain LEDs (including OLEDs) as light sources tend slightly to dazzle a viewer because the light sources are virtually punctiform. In addition, depending on the location in which the luminaire is used, e.g. as an office luminaire, a light distribution is desired which is weak enough to avoid glare at high radiation angles relative to the normal perpendicular to the light exit face.

Such light distributions for glare-free luminaires in interiors are achieved for example by specific covering of the luminaires for glare suppression. Such covers may contain microstructures or textures which effect light scattering to a certain extent. The covers are also obtainable as comparatively thin films.

It is also known to use such glare suppression covers in combination with reflectors to increase the total efficiency of the luminaire.

SUMMARY

The object of the present description is to develop a luminaire of the type in question to provide a glare-free, soft light distribution with a sufficient full width at half maximum for use as built-in or attached ceiling luminaires or pendant ceiling luminaires, e.g. for office lighting.

A special property of the luminaire consists in that the planar translucent cover extends inwards into the reflector, i.e. in the direction of the light source, preferably to a point, relative to the plane of the light exit opening. This means that the light influenced by the microstructures in the cover is deflected towards the centre axis of the luminaire rather than emitted in the plane of the light exit opening. This produces an effect similar to that of slats in a conventional luminaire. The light distribution at high radiation angles, e.g. at angles above 85°, 80° or 65°, is reduced to improve the glare suppression of the luminaire.

According to a non-limiting embodiment, the shape of the light-directing cover is defined by the side wall of a pyramid or of a cone, wherein the base of the pyramid or of the cone lies in the imaginary plane which is defined by the edge of the reflector. The pyramid or conical shape has the advantage that the inclination angle of the cover to the imaginary plane, which may be arranged parallel to the ceiling of the room, is always constant.

According to a non-limiting embodiment, an angle which is formed in a cross-section perpendicular to the imaginary plane between the face of the translucent cover and the imaginary plane is less than 30°, preferably less than 20° or 15°. This shallow angle is sufficient to achieve the effect that the light emission in solid angle ranges above e.g. 85°, in particular 80° or 65°, is reduced or shielded. The shallow inclination angle specifically prevents light being deflected to a significant extent so far to the opposite side of the luminaire that it is emitted on the side opposite the central axis within a solid angle range above a desired shielding angle. The shape of the cover in combination with the microstructure elements ensures that the light is scattered by the microstructures to prevent reflected glare on the one hand and excessively high radiation angles are avoided to prevent direct glare by shielding. Alternatively or additionally, the height of the translucent cover by which it protrudes from the imaginary plane into the reflector may be limited to less than ⅕, preferably ⅛, of the largest diameter in the imaginary plane. This height-to-width ratio of the cover ensures that, as explained above, light emission above a limit angle relative to the luminaire normal is prevented or at least reduced.

According to a non-limiting embodiment, the microstructures comprise textures on a surface of the cover facing the light source and/or facing away from the light source. The textures may in particular comprise lenticular or prism-shaped elevations and/or depressions. The elevations and/or depressions may be arranged regularly or irregularly. The shape of the textures should help to ensure that the light is scattered or dispersed locally at the cover. The inclination of the cover relative to the light outlet opening then improves the shielding for glare suppression.

According to a non-limiting embodiment, the microstructures may also be formed by scattering particles in the material of the cover and/or on a surface of the cover. The scattering particles have a similar function to the surface textures, i.e. they create local light scattering. Textures or scattering particles on the inside of the cover have the advantage that they are not damaged when the cover is cleaned. On the other hand, textures and scattering particles on the outside have the advantage that no reflections on the otherwise flat surface are visible when the cover is viewed from above.

According to a non-limiting embodiment, an additional reflector is provided, which adjoins the peripheral edge on the side of the cover facing away from the light source. The additional reflector may act as a cutoff reflector which improves shielding of the light distribution. The reflector and the additional reflector may also be connected integrally to each other, the peripheral edge of the reflector, as mentioned above, being in this case formed by the edge at which the transparent cover bears against the assembled reflector.

According to a non-limiting embodiment, the reflector and/or the additional reflector may be high-gloss. This embodiment achieves a high degree of luminaire efficiency. However, the reflector and/or the additional reflector may also be diffusely reflective, in particular matt white. These embodiments further reduce the risk of possible glare.

According to a non-limiting embodiment, the light source may comprise an array of LEDs which are arranged in a plane at the bottom of the reflector. In contrast to a single LED, the distribution of the light with an array of LEDs is already more favourable, i.e. better distributed, at the location of the light source. The multiple LEDs also allow different light colours of the LEDs to be mixed. It is also possible for the LEDs to be arranged in groups together, each point in the array preferably comprising a group of LEDs with each colour if multicoloured LEDs are used. Different colours may be mixed thereby. Where appropriate, the different-coloured LEDs may also be activated separately from each other to change the light colour of the luminaire.

According to a non-limiting embodiment, the LEDs or groups of LEDs are distributed uniformly over the bottom of the reflector. Alternatively, the LEDs may also be arranged around a peripheral edge of the bottom of the reflector. The latter has the advantage that the proportion of the light which is reflected by the laterally arranged reflector is increased in comparison with a flat arrangement of the LEDs on the bottom. This may likewise contribute to the glare suppression of the luminaire. In contrast, the uniform distribution of the LEDs on the bottom has the advantage that the area of the translucent cover is illuminated more uniformly, so that the light exit openings of the luminaire appear uniformly bright when viewed from outside. According to a non-limiting embodiment, the smallest distance of each LED or each LED group from its closest neighbour is greater than 10 mm. This is a relatively large spacing of the LEDs in an LED array, which the viewer would normally find annoying because the LEDs are perceived as individual, separate points of light. However, this disadvantage is overcome by combination with the cover according to the description. It is therefore possible to arrange the LEDs with a comparatively large spacing to create a luminaire having a large area without the viewer being able to visually resolve the individual light points of the LEDs or of the LED groups.

According to a non-limiting embodiment, each LED is assigned a primary lens, e.g. to disperse the light of each LED or to focus it towards the cover. Combinations of different primary lenses are also possible. For example, the primary lenses in an outer ring and/or one or more primary lenses in the centre of the LED array may have a different radius of curvature than the primary lenses of the other LEDs in the array. This allows different light effects to be produced in the region in which the light of the LEDs is predominantly reflected by the lateral reflector walls and the light which is predominantly incident directly onto the tip of the inwardly pointing cover of the luminaire.

According to a non-limiting embodiment, at least some primary lenses are flattened at their vertices. This produces a combination of focussing in the edge region of the LED and defocussing in the central region of the LED. The flattening of the vertex may also be different depending on the position of the primary lens in the LED array. In particular, the flattened portions of the lenses may increase or decrease in a stepped manner in concentric rings of the LED arrangement so that the light of each LED in the array produces approximately the same light distribution after passing through the translucent cover. The differently flattened vertices may also be combined with the different radii of curvature as described above.

According to a non-limiting embodiment, the LEDs have different colours. It may be advantageous to mix a colder and a warmer light colour to emit a mixed white light from the LED array. While the cold light tends to support human visual function, a warm white tone ensures a more pleasant feeling. The combination of the cold and warm light sources is therefore ideally suitable for illuminating an interior, e.g. an office. It is also possible to activate different-coloured light sources separately so that the mixed colour of the luminaire may be selected by dimming the light sources differently.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various aspects are described with reference to the following drawings, in which.

DETAILED DESCRIPTION

A first non-limiting embodiment of the luminaire according to the description is described with reference to FIG. 1.

The luminaire has a baseplate 2 which may in particular be formed by a PCB (printed circuit board). An arrangement of multiple LEDs 4 is provided on one side of the baseplate, which is flat. In this embodiment, the LEDs 4 are distributed uniformly over the baseplate 2 and are electrically connected to electrical conductor tracks on the baseplate. A reflector 6 extends around the array of LEDs 4, which reflector, in the embodiment shown in FIG. 1, defines a square in each horizontal section perpendicular to the image plane of FIG. 1. The reflector 6 is reflective on the inwardly pointing side. In one embodiment in particular, the reflector walls are matt white.

On the side of the reflector 6 opposite the LEDs, the peripheral edge of the reflector forms a light exit opening. This is closed with a cover 8. The cover 8 is shown as a single part in a perspective view in FIG. 4 and in a side view in FIG. 5.

The cover 8 is formed from an optically transparent material. The cover 8 has on its surface a plurality of microstructures which are in particular in the form of microlenses or microprisms on a surface of the cover 8. The microstructure may be distributed regularly or irregularly on the cover 8.

Figure 4:
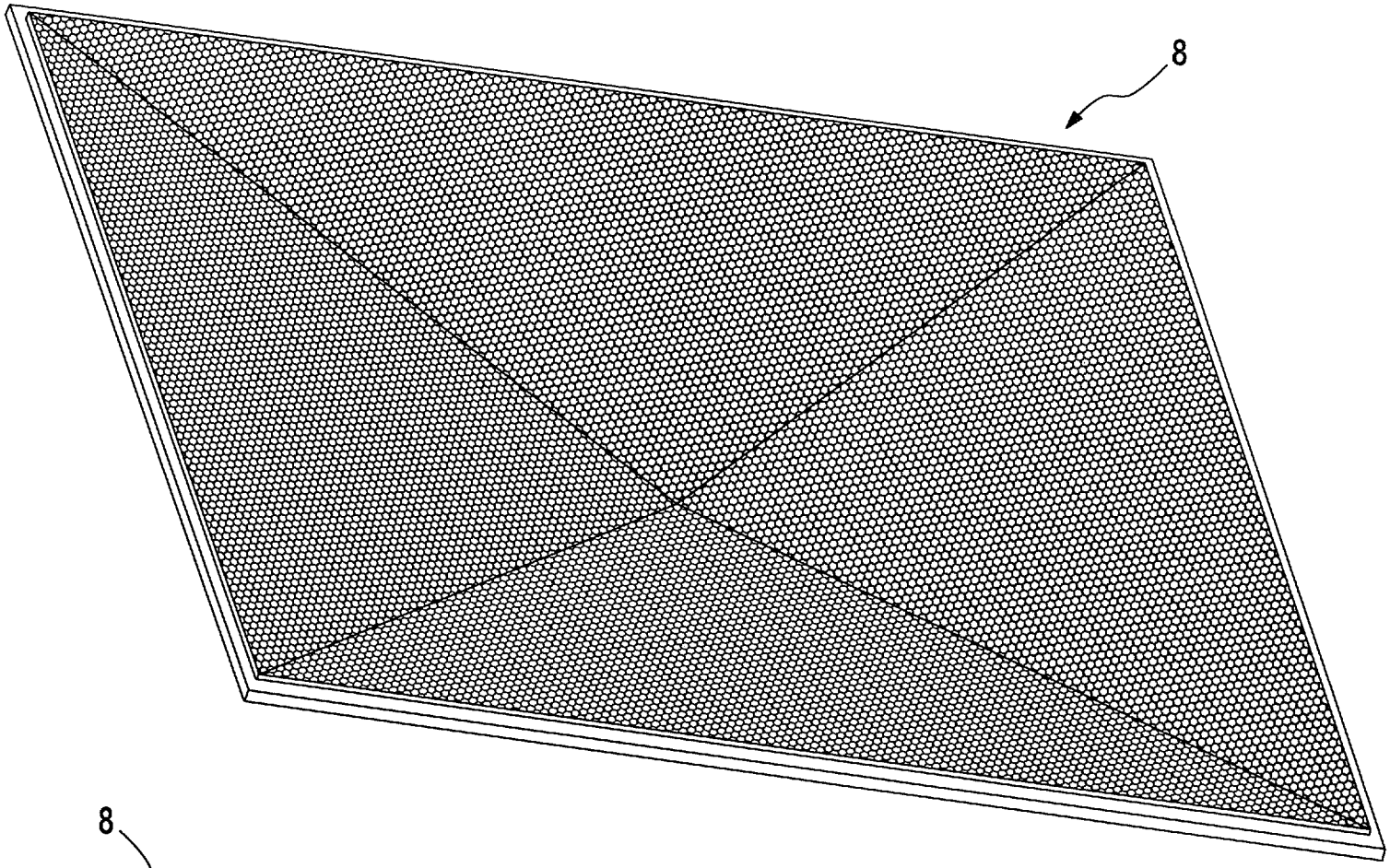
FIG. 4 shows a perspective view of a cover for one of the luminaires of FIGS. 1 to 3.
Figure 5:
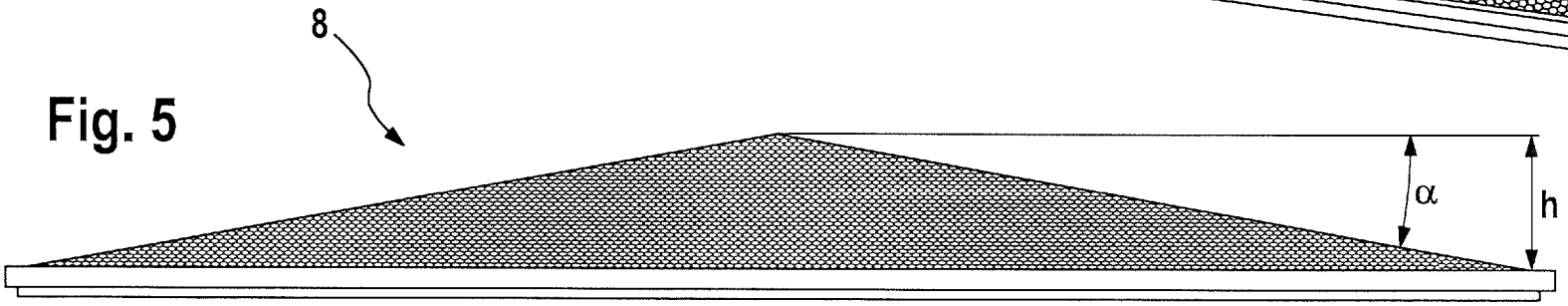
FIG. 5 shows the cover of FIG. 4 in a side view.

It may be seen in FIG. 4 that the microstructures are arranged in a regular pattern.

The microstructures of the cover 8 have the effect that the light which passes through the cover 8 is deflected to the side. In particular, the microstructures ensure that the light is partially scattered.

A particular property of the cover 8 is that it extends inwards towards the LEDs 4 in a pyramid-shaped manner. This produces an angle α between each side of the cover 8 and a plane parallel to the base 2 or parallel to the plane of the light exit opening which is formed by the peripheral edge of the reflector 6. In the embodiments shown, the inclination angle α is 10°. The angle is preferably less than 30° or in particular less than 20°. The shallow angle has the effect that the light is not only scattered by the cover 8 but also deflected somewhat towards a central axis z of the luminaire. This produces a desired light distribution of the luminaire, which is greater at large radiation angles relative to the optical axis z (see FIG. 1) than a uniformly illuminated flat plate (i.e. the luminaire has a light distribution narrower than a Lambert distribution in a C plane). In particular, improved shielding of the luminaire may be realised thereby.

The material of the cover 8 may be in particular a transparent plastic or a glass. The microstructures may in particular be formed as depressions or elevations in the surface of the material, in the form of pyramid-shaped optical elements or lenticular optical elements. The pyramid-shaped or lenticular depressions or generally any kind of surface texture suitable for dispersing, in particular scattering, light may be provided on the side facing the lighting means or on the opposite outer side of the cover 8.

Alternatively or additionally, scattering centres may also be provided inside the material or on a surface of the material of the cover 8. Scattering centres may be formed e.g. by small particles in an otherwise transparent glass or plastic material.

It may also be provided for the surface of the cover 8 to be frosted. A type of opal glass may be formed by treating the surface by etching or sandblasting.

Figure 1:
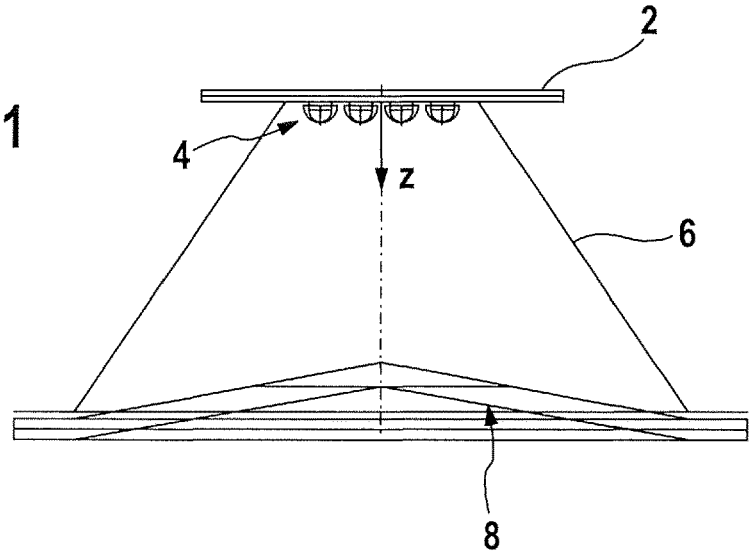
FIG. 1 shows a cross-section through a luminaire.
Figure 6:
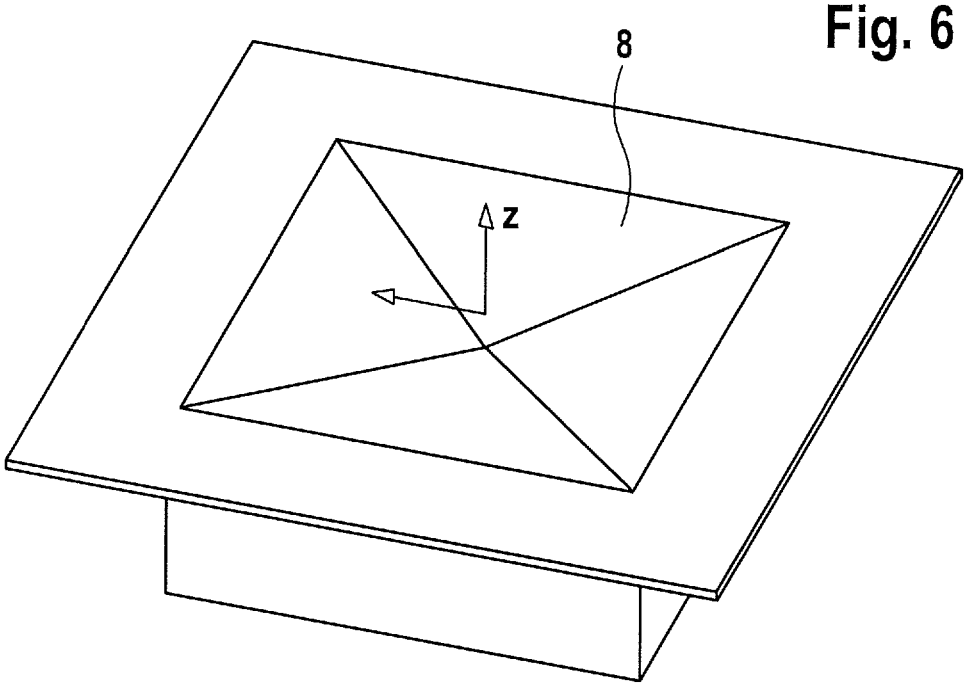
FIG. 6 shows a perspective diagram of a luminaire.

A luminaire according to FIG. 1 is shown in a perspective view in FIG. 6. The luminaire is in the form of a built-in or attached ceiling luminaire. Preferably, a wide edge extends around the cover 8 in the light exit opening. The luminaire may be integrated into a ceiling or attached to a ceiling. The luminaire may also be mounted at a distance from the ceiling, e.g. as a pendant luminaire or standard luminaire. Preferably, the luminaire is constructed such that it is mounted with the light exit opening down towards an interior to be illuminated. The light distribution which is produced by the cover 8 is suitable for this type of luminaire mounting.

Figure 2:
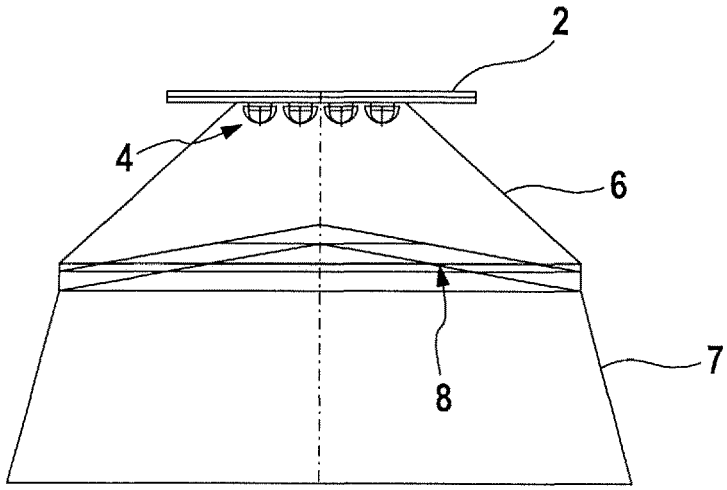
FIG. 2 shows a cross-section through a further luminaire.
Figure 3:
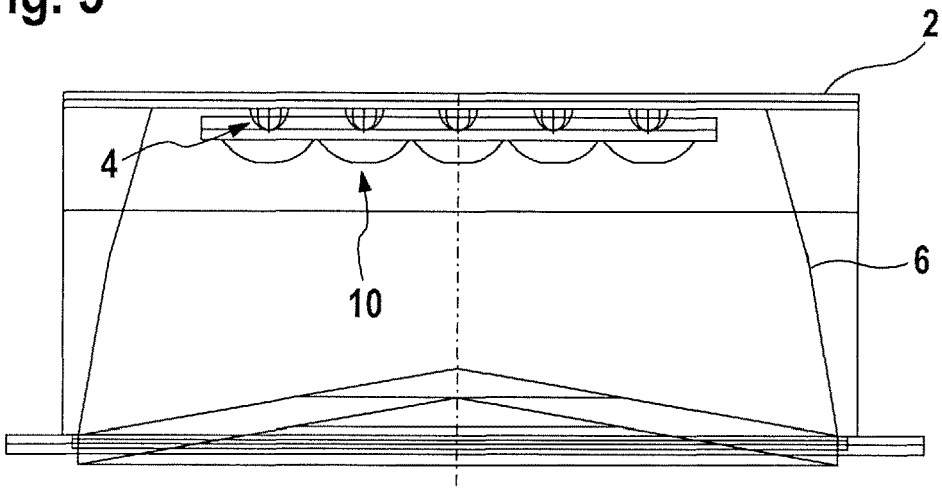
FIG. 3 shows a cross-section through a further luminaire.

FIGS. 2 and 3 show alternative embodiments of the luminaire. In FIG. 2, a further reflector 7 is provided on the side of the cover 8 facing away from the lighting means. The reflector acts as a cutoff reflector to improve shielding of the luminaire. The inwardly facing sides of the further reflector 7 are in particular high-gloss. It is also possible for the reflectors 6 and 7 to be formed integrally with each other and for the cover 8 to be integrated therein.

In the non-limiting embodiment of FIG. 3, an arrangement of primary lenses 10 is also provided over the LEDs 4. The primary lenses 10 may be connected integrally to one another, as shown in FIGS. 13 to 17. The primary lenses 10 can, as explained below, have particular shapes to help form a desired light distribution in combination with the cover 8.

Figure 7:
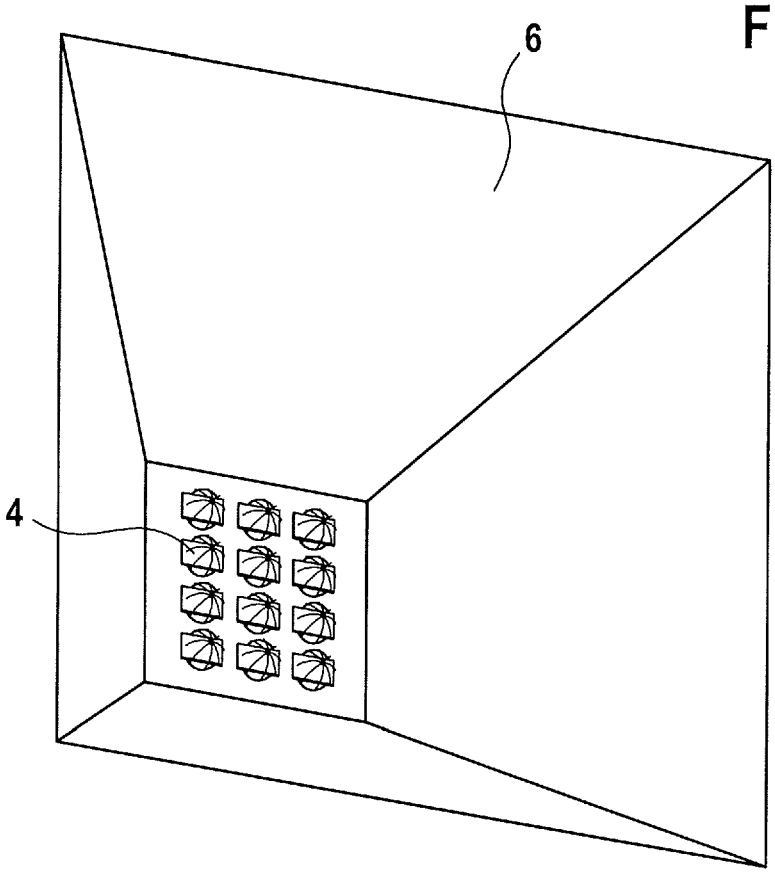
FIG. 7 shows a perspective view without the cover.
Figure 8:
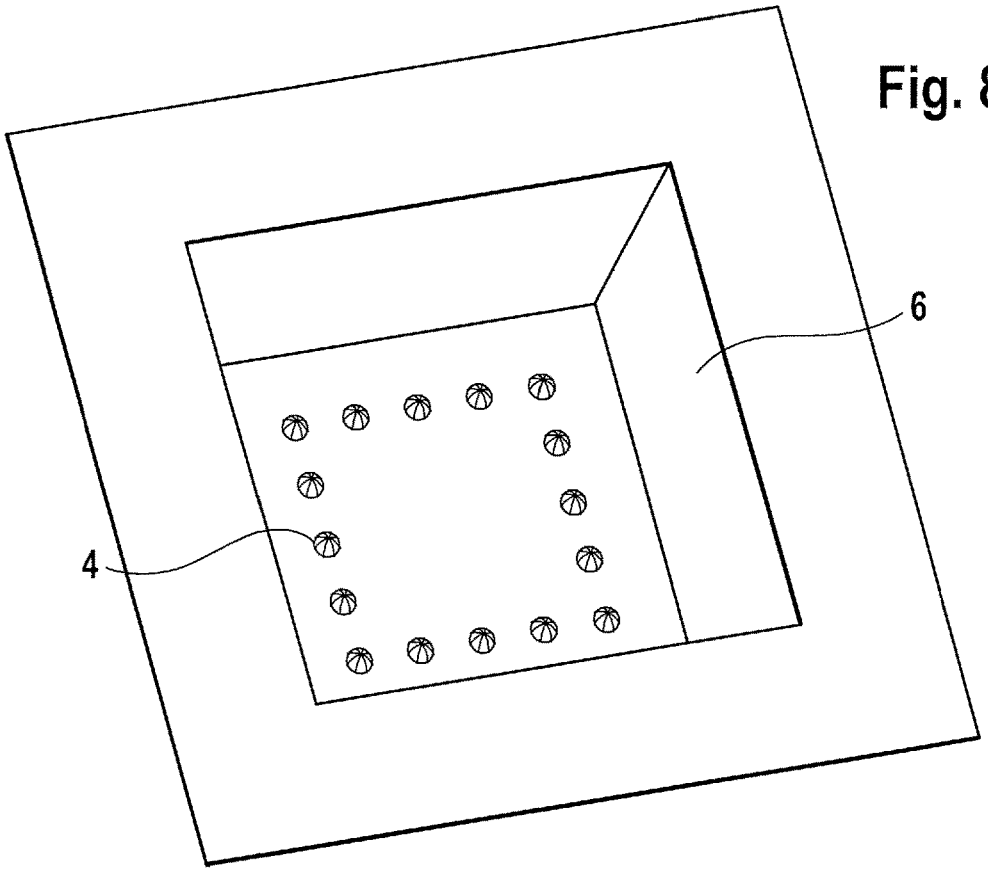
FIG. 8 shows a perspective view of a further luminaire without the cover.
Figure 9:
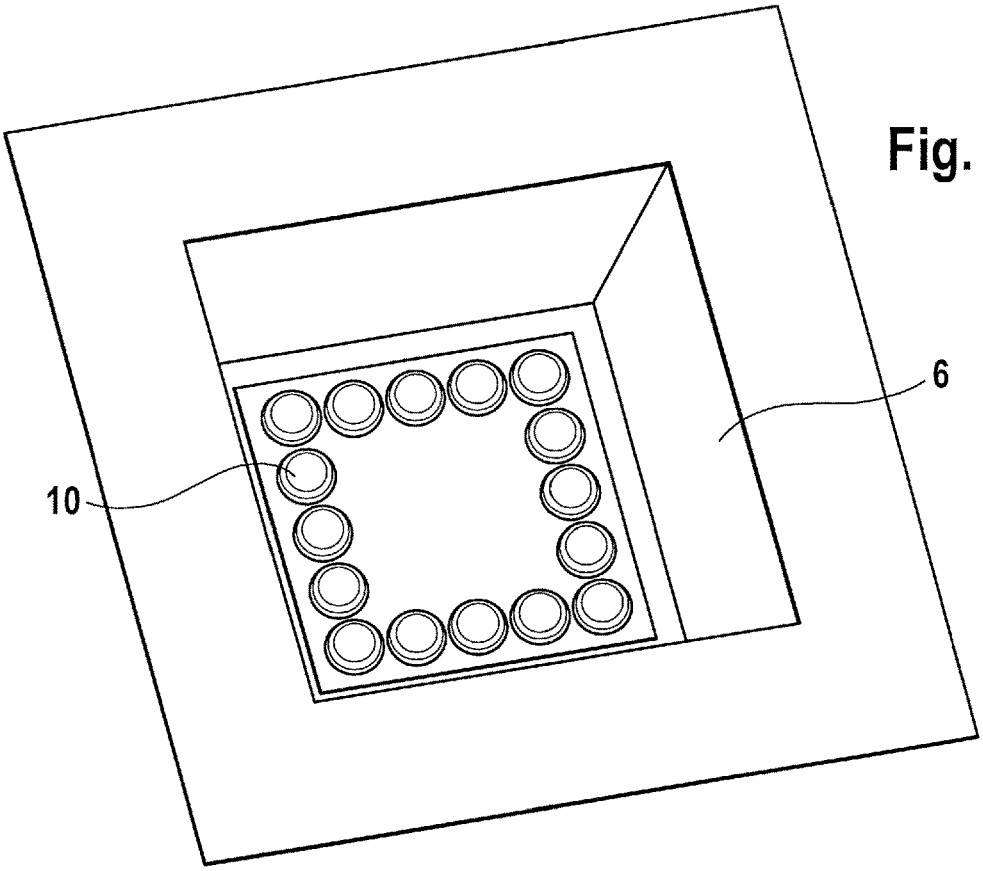
FIG. 9 shows the luminaire of FIG. 8 with primary lenses.

In FIG. 7, the luminaire of the description is shown without the cover 8. The plan view of the array of LEDs 4 may therefore be seen. In FIG. 7, an LED array comprises 4×3 LEDs. An alternative embodiment is shown in FIG. 8. In this case, the LEDs are only arranged on the edge of the base 2 inside the reflector 8. FIG. 9 shows the luminaire of FIG. 8 with primary lenses 10 arranged over the LEDs.

It should be understood that the cover 8 has been omitted from FIGS. 7 to 9 only for reasons of illustration.

Figure 11:
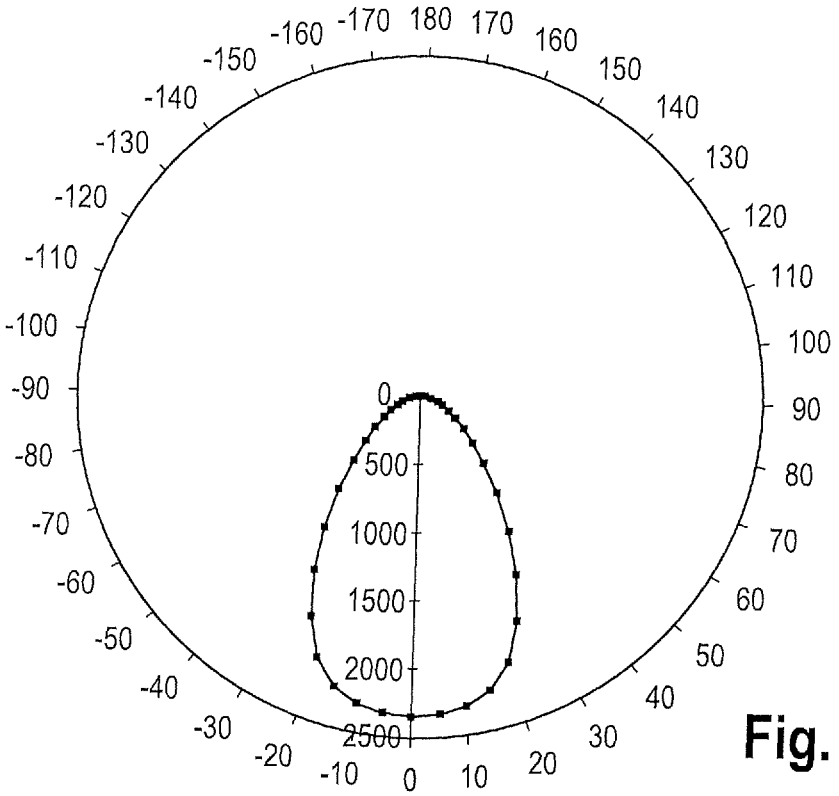
FIG. 11 shows a polar diagram of a light distribution curve in a C plane for a luminaire of FIG. 7 with a high-gloss reflector.
Figure 12:
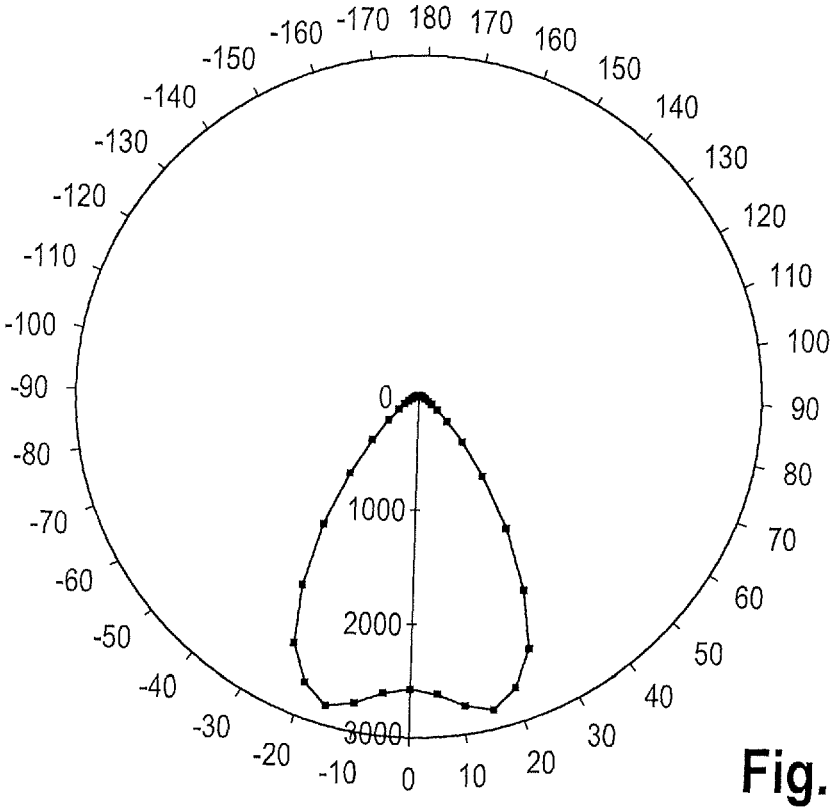
FIG. 12 shows a polar diagram of a light distribution curve in a C plane for a luminaire of FIG. 3 with a matt-reflective reflector.

Embodiments such as in FIG. 7 with a diffusely reflective reflector produce a light distribution in a C plane, which is shown schematically in FIG. 11. The light distribution has a maximum at 0° and decreases comparatively rapidly towards ±90°. In contrast, FIG. 12 shows a schematic light distribution in a C plane of a luminaire with a high-gloss (specular) reflector, as is shown e.g. in FIG. 3. The light distribution has a local minimum at 0° and increases towards the flanks to approximately 15° and then falls comparatively quickly towards ±90°.

FIGS. 10*a* to 10*d* show different embodiments of LED arrays which may be combined with the luminaires as described above.

Figure 10A:
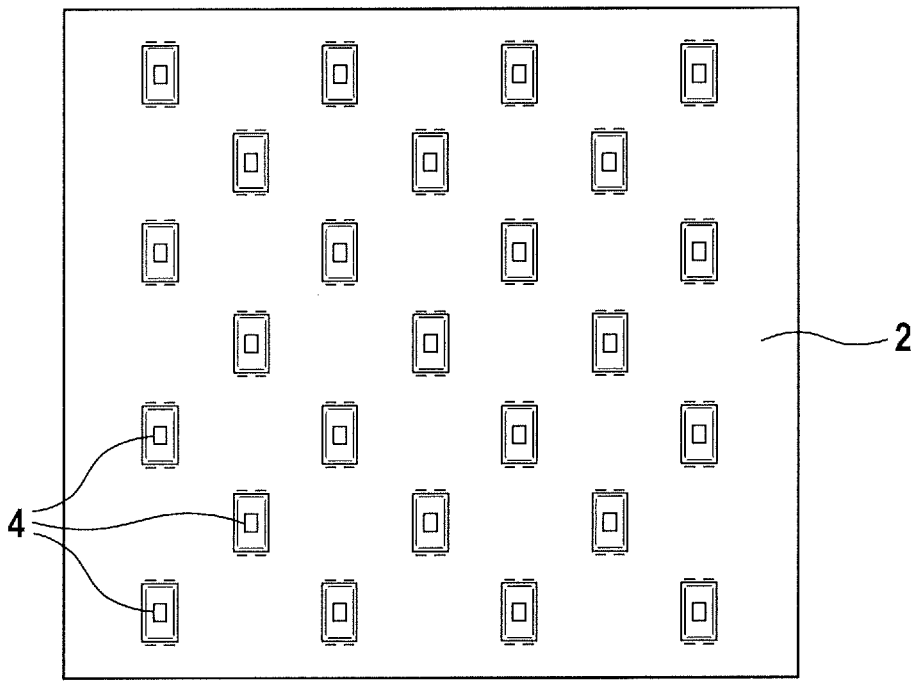
FIGS. 10*a-d* show views of different LED arrays.

The light distributions which are achieved with the above-described LED arrays may be produced in particular with different-coloured LEDs. For example, it may be advantageous to provide the LEDs with a warm light colour according to the arrangement in FIG. 10*c*, while LEDs having a colder light colour are provided according to the arrangement in FIG. 10*d*. Both arrangements are combined so that, when all the LED positions are occupied, an LED array according to FIG. 10*a* is formed. However, the different colours have different light distributions. In particular, the groups of LEDs may be activated differently so that only a warm white or only a cold white light is produced, as required. However, it is also possible to arranged multiple colours of LEDs at one point in the LED array, e.g. at the LED positions according to FIG. 10*b*. In this case, approximately the same light distributions are achieved for the different light colours. However, the light colours may also be activated separately from one another in this embodiment.

Figure 10B:
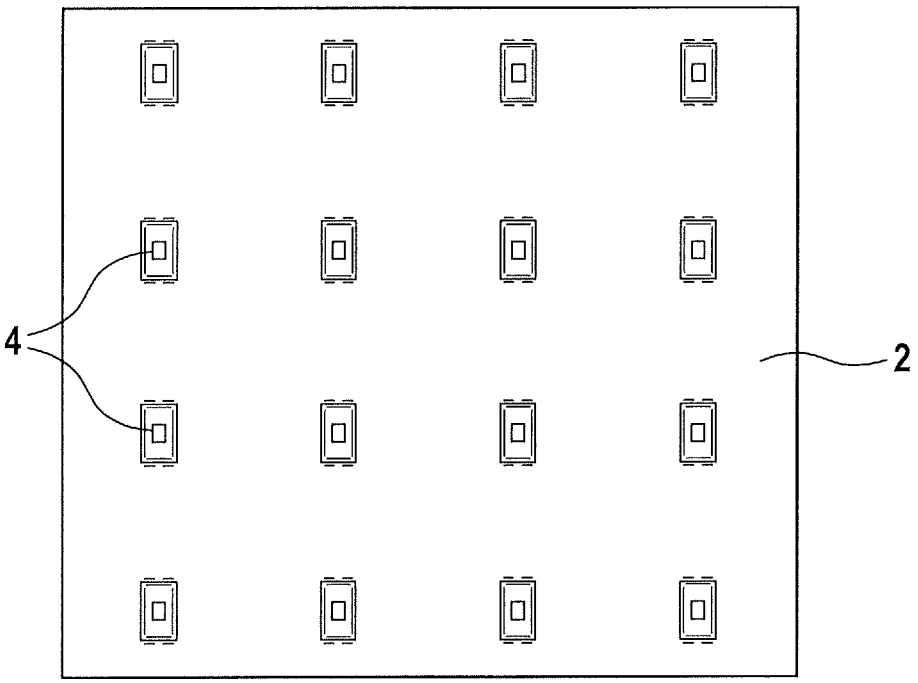

The distance from one LED to the neighbour arranged at right angles thereto is e.g. between 10 and 20 mm, in particular approximately 16 mm, according to FIG. 10*b*. The LEDs arranged offset to this in the array of FIG. 10*a* are arranged at half the distance. The distances between the LEDs in the array are comparatively large, and therefore they would be perceived by the viewer as individual points of light when viewed directly. However, the cover 8 ensures that the individual points of light are no longer visible and an approximately uniformly luminous surface is perceived by the viewer.

Figure 13:
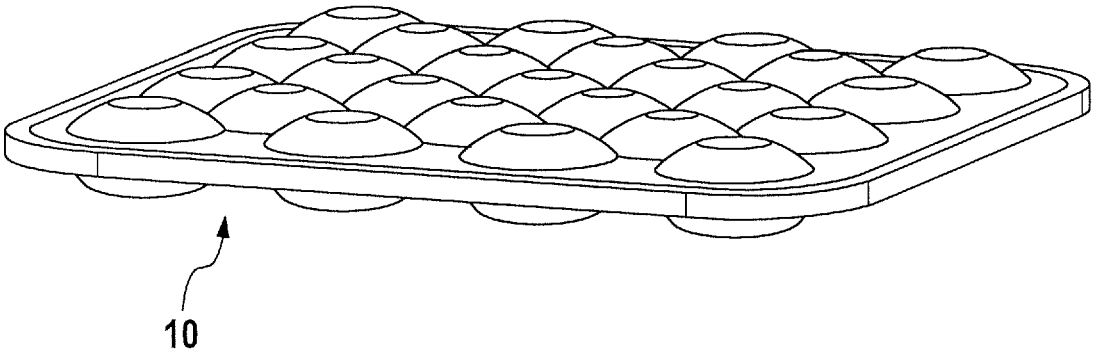
FIG. 13 shows a perspective diagram of an arrangement of primary lenses.
Figure 14:
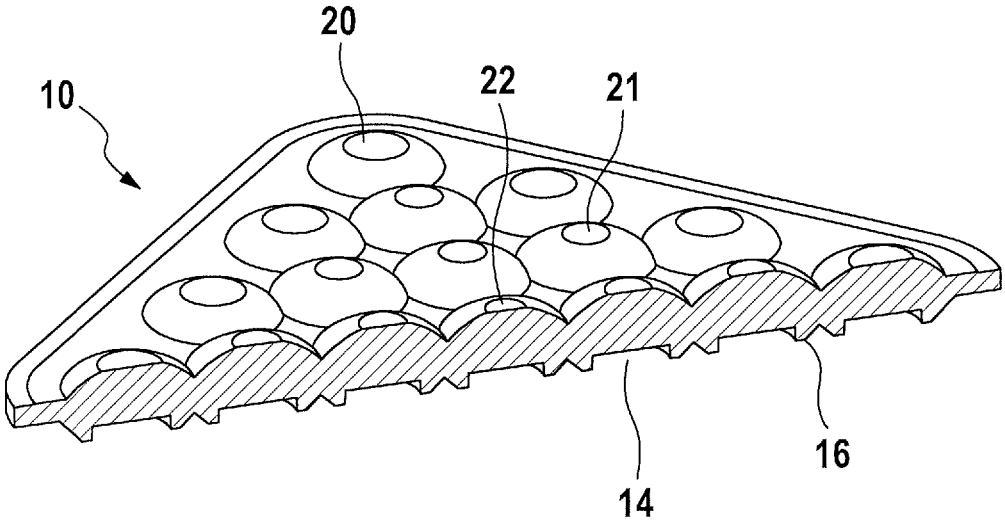
FIG. 14 shows a section through the arrangement of primary lenses according to FIG. 13.
Figure 15:
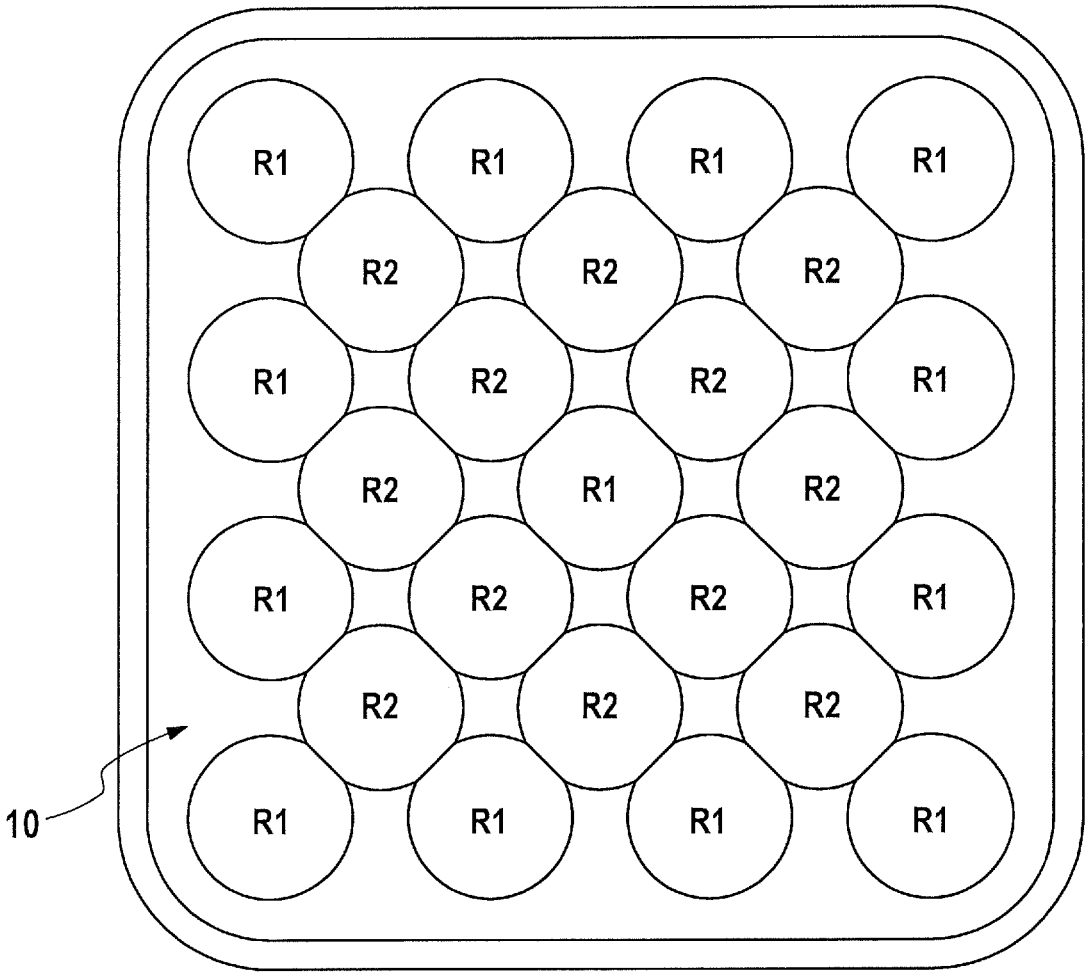
FIG. 15 shows a plan view of an arrangement of primary lenses according to FIG. 13 on the side facing away from the LEDs, with different radii of curvature of the primary lenses.

In addition to the LED arrays, an array of primary lenses 10 may be arranged directly over the LEDs 4, as shown in FIG. 13. FIG. 14 shows a section through the arrangement of the primary lenses according to FIG. 13. The individual primary lenses have on the side facing the LEDs an entry face 14 which is surrounded by a cone 16. The cone has an angle to the optical axis of the LED such that total internal reflection takes place at the cone faces. The entry face 14 in combination with the cone 16 therefore allows light to be coupled efficiently into the primary lens. The primary lenses may have different radii of curvature, as shown in FIG. 15. The primary lenses in a central ring of the primary lens array have a radius R1. The outer primary lenses have a radius R2, the central primary lens has a radius R1. A desired light distribution curve may be produced by the distribution of the radii over the lenses.

Figure 16:
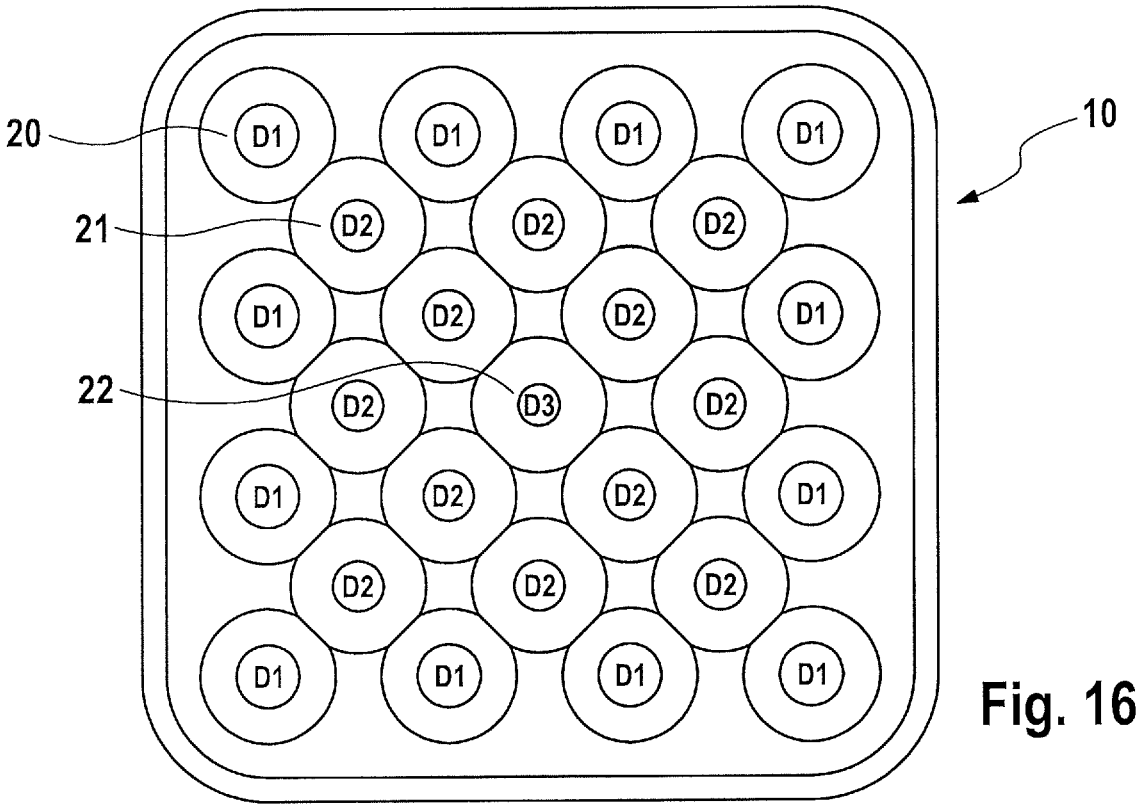
FIG. 16 shows a plan view of an arrangement of primary lenses according to FIG. 13 on the side facing away from the LEDs, with differently flattened vertices of the primary lenses.
Figure 17:
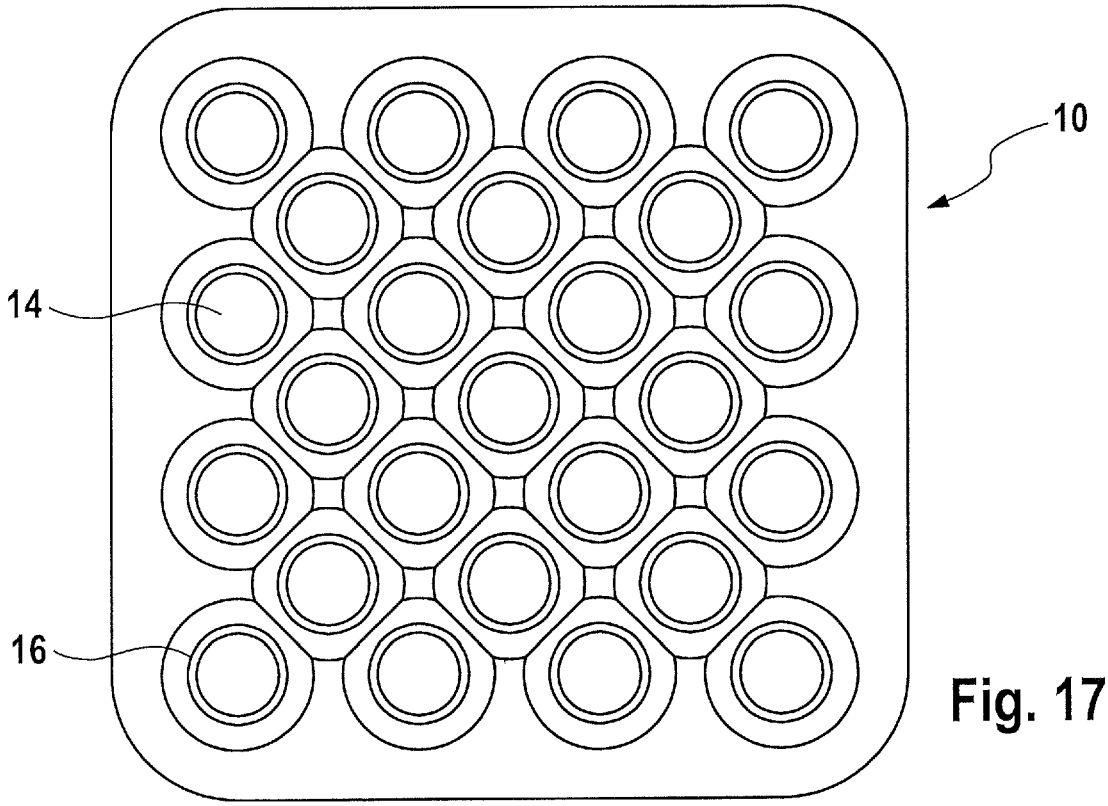
FIG. 17 shows a plan view of an arrangement of primary lenses according to FIG. 13 on the side facing the LEDs.

On the side opposite the LEDs, the primary lenses also have flattened vertices 20, 21 or 22, as shown in FIG. 16. The primary lenses 20 on the edge of the arrangement have a flattened vertex with a larger diameter D1 than the primary lenses 21 and 22 which are provided inside the arrangement. The primary lenses 21 have a flattened vertex with a diameter D2, and the primary lenses 22 have a flattened vertex with a diameter D3, where D1>D2>D3.

Figure 10C:
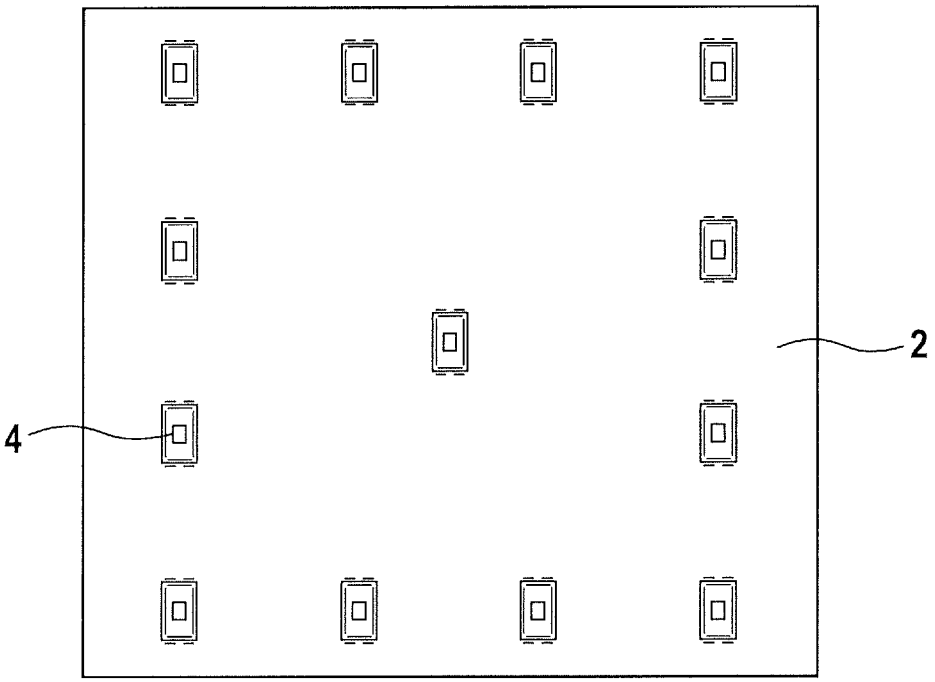
Figure 10D:
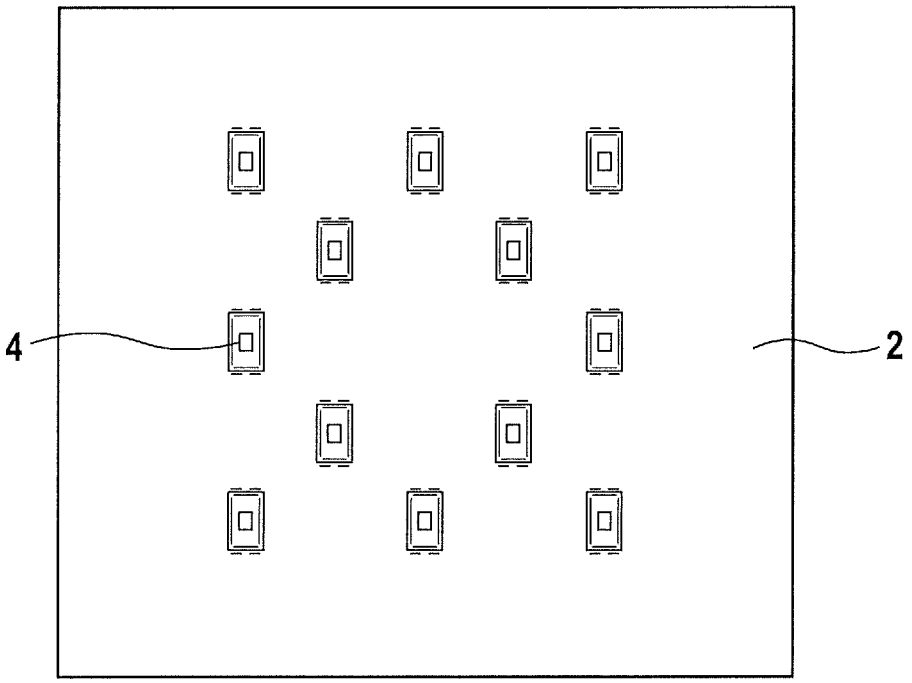

The flattened vertex of the lenses has the effect that the light distribution according to the cover 8 of the LED arrays of FIGS. 10*c* and 10*d* or according to a combination of the two, as shown in FIG. 10*a*, is in each case the same shape. For example, the LEDs in an array according to FIGS. 10*c* and 10*d* may each have different colours. Both LED arrays are superimposed to form the arrangement of FIG. 10*a* and thus have, after passing through the cover 8, the same light distribution curve, so that the two light colours mix homogeneously.

Numerous variants of the above-described embodiments are possible within the scope of the invention as defined by the claims. In particular, the invention is not limited to the illustrated square arrangement of the LED arrays and of the light exit face of the reflector. Round symmetries may also be used, in particular in conjunction with, for example, conical translucent covers 8. Rectangular shapes for the light exit face and the cover are also possible. In this case, for example, a planar pyramid-shaped cover with a rectangular base may be used. However, the covers are preferably flat, i.e. the shorter side is for example at least half of a longer side, to achieve similar optical effects in all directions.

While specific aspects have been described, it should be understood by those skilled in the art that various changes in form and detail may be made therein without departing from the spirit and scope of the aspects of this disclosure as defined by the appended claims. The scope is thus indicated by the appended claims and all changes which come within the meaning and range of equivalency of the claims are therefore intended to be embraced.

LIST OF REFERENCE SYMBOLS

2 Base
4 LED
6 Reflector
7 Further reflector, in particular cutoff reflector
8 Cover
10 Primary lens, individual or connected to one another
14 Light entry side
16 Cone
20 Primary lens with flattened vertex
21 Primary lens with flattened vertex
22 Primary lens with flattened vertex
α Angle of inclination
h Height
D1, D2, D3 Flattened vertices of primary lenses
R1, R2 Radii of curvature of primary lenses

The invention claimed is:

1. A luminaire comprising:
a light source comprising at least one LED and a reflector, wherein a peripheral edge of the reflector defines a light exit opening on a side opposite the light source;
a planar translucent cover arranged in the light exit opening;
microstructures configured to direct light, scatter light, or combinations thereof, wherein the microstructures are distributed over the planar translucent cover; and
wherein the planar translucent cover extends inwards in the direction of the light source, relative to an imaginary plane defined by the peripheral edge of the reflector.

2. The luminaire according to claim 1, wherein the shape of the planar translucent cover is defined by the side walls of a pyramid or of a cone, wherein the base of the pyramid or of the cone corresponds to the imaginary plane.

3. The luminaire according to claim 1, wherein an angle is formed in a cross-section perpendicular to the imaginary plane between a face of the planar translucent cover and the imaginary plane is less than 30°; wherein a height of the planar translucent cover by which it protrudes from the imaginary plane into the reflector is less than ⅕ of the largest diameter in the imaginary plane; or combinations thereof.

4. The luminaire according to claim 1, wherein the microstructures comprise textures on a surface of the cover facing the light source, facing away from the light source, or combinations thereof.

5. The luminaire according to claim 4, wherein the textures comprise lenticular or prism-shaped elevations or depressions.

6. The luminaire according to claim 1, wherein the microstructures contain scattering particles in the material of the cover, on one of the surfaces of the cover, or combinations thereof.

7. The luminaire according to claim 1, wherein the reflector is high-gloss or diffusely reflective.

8. The luminaire according to claim 1, wherein the at least one light source comprises an array of LEDs;
wherein the array of LEDs are arranged in a plane at a bottom of the reflector.

9. The luminaire according to claim 8, wherein the array of LEDs are distributed uniformly over the bottom of the reflector.

10. The luminaire according to claim 8, wherein the LEDs are arranged around a peripheral edge of the bottom of the reflector.

11. The luminaire according to claim 8, wherein the smallest distance of each LED or an LED group from its closest neighbour is greater than 10 mm.

12. A luminaire comprising:
a light source comprising at least one LED and a reflector, wherein a peripheral edge of the reflector defines a light exit opening on a side opposite the light source;
a planar translucent cover arranged in the light exit opening; wherein the planar translucent cover extends inwards in the direction of the light source, relative to an imaginary plane defined by the peripheral edge of the reflector;
microstructures configured to direct light, scatter light, or combinations thereof;
wherein the microstructures are distributed over the planar translucent cover; and
an additional reflector adjoining the peripheral edge on the side of the cover facing away from the light source.

13. The luminaire according to claim 12, wherein the additional reflector is high-gloss or diffusely reflective.

14. A luminaire comprising:
an array of LEDs and a reflector, wherein a peripheral edge of the reflector defines a light exit opening on a side opposite the light source;
a planar translucent cover arranged in the light exit opening; wherein the planar translucent cover extends inwards in the direction of the light source, relative to an imaginary plane defined by the peripheral edge of the reflector;
microstructures configured to direct light, scatter light, or combinations thereof are distributed over the planar translucent cover;

a plurality of primary lens; wherein each LED of the array of LEDs is assigned to a primary lens; wherein each primary lens of the plurality of primary lenses assigned to each LED in an outer ring of the LED array, the plurality of primary lenses assigned to the LEDs in the centre of the LED array, or combinations thereof, have a different radius of curvature than the primary lenses assigned to the other LEDs in the LED array.

15. The luminaire according to claim 14, wherein at least some of the primary lenses of the plurality of primary lenses are flattened at the vertex.

16. The luminaire according to claim 14, wherein the LEDs have different colours to emit a mixed white light from the array.

* * * * *